United States Patent [19]

Turner

[11] Patent Number: 4,492,835

[45] Date of Patent: Jan. 8, 1985

[54] LOAD INTERRUPTER DEVICE

[75] Inventor: John L. Turner, Fairview Heights, Ill.

[73] Assignee: Turner Electric Corporation, East St. Louis, Ill.

[21] Appl. No.: 396,457

[22] Filed: Jul. 8, 1982

[51] Int. Cl.[3] ..... H01N 33/66

[52] U.S. Cl. ..... 200/144 B; 200/145

[58] Field of Search ..... 200/144 B, 145

[56] References Cited

U.S. PATENT DOCUMENTS

| | | | |
|---|---|---|---|
| 2,838,636 | 6/1958 | Schwager | 200/144 B |
| 2,915,611 | 12/1959 | Luehring et al. | 200/145 |
| 3,247,348 | 4/1966 | Forwald | 200/145 |
| 3,576,961 | 5/1971 | Turner | 200/144 B |
| 3,956,721 | 5/1976 | Link | 200/144 B |

*Primary Examiner*—Robert S. Macon

*Attorney, Agent, or Firm*—Haverstock, Garrett & Roberts

[57] ABSTRACT

A load interrupter device has a plurality of load interrupter contacts enclosed respectively in axially aligned vacuum bottles, each bottle containing a fixed contact and a second contact movable axially away from the fixed contact to open position and toward the fixed contact to closed position, the bottles being positioned in a tubular housing of dielectric material by a series of stacking pedestals each formed with three equi-angularly spaced radial arms engaging the inner surface of the tubular housing. Each movable contact is normally resiliently biased toward closed position and is moved to open position by a toggle having a pair of arms substantially aligned with the contacts and held in this position by springs connected to arms on the operating shaft such that when the operating shaft is rotated by the operating arm, the above-mentioned springs break the toggle, causing the individual contacts to open. A reset spring returns the operating shaft and operating arm to ready position and causes the toggle to return the contacts to their normal closed positions. The intermediate stacking pedestals by which the bottles are centered in the housing are anchored to the housing by stabilizing studs to eliminate excessive stresses in the vacuum bottle bellows and resultant maladjustment of the contact synchronism, and the stabilizing studs project outwardly through the housing to permit individual testing of each vacuum bottle.

17 Claims, 9 Drawing Figures

LOAD INTERRUPTER DEVICE

BACKGROUND OF THE INVENTION

1. Field of the Invention

The invention relates to sectionalizing switch gear and consists particularly in a load interrupter device having operating mechanism responsive to opening of air break switches.

2. The Prior Art

In some switch gear of this type, load interrupter switches have utilized cam devices for releasing the movable interrupter contacts and moving them to open position, as exemplified in my U.S. Pat. No. 3,576,961.

SUMMARY OF THE INVENTION

The invention provides toggle means for locking and unlocking the movable contacts of an interrupter device responsive to opening movements of associated air break switches.

The invention also provides means for anchoring a plurality of vacuum bottles in an interrupter housing to prevent relative axial movement between the respective bottles and thus eliminate excessive stresses on the vacuum bottle bellows and resultant maladjustment of the contact synchronism.

The invention also provides means for positioning the operating mechanism toggle arms to adjust the time for opening the interrupter contacts such that the air break switch blade and its stationary contact will open a sufficient distance to prevent a re-strike when the interrupter contacts opens.

The invention also provides resilient means causing the toggle to reclose all the interrupter contacts after the switch blade is completely open.

The invention also provides means comprising stabilizing studs extending radially from the intermediate stacking pedestals through the housing, for anchoring the stacking pedestals to the interrupter housing, thereby eliminating axial movement of the vacuum bottles, excessive bellows stresses in the vacuum bottles and consequent maladjustment of the contact synchronism during installation, shipping and other conditions subjecting the mechanism to substantial forces. The projection of the stabilizing studs outwardly through the housing permits them to serve as test studs for individually testing each of the vacuum bottles.

The interrupter device is constructed for installation on the air break switch so as not to be in the circuit except during the final opening operation cycle of the air break switch, thereby obviating damage to the device from excessive current or fault conditions in the circuit. Since it is not in the circuit at all during the closing operation, it cannot be damaged by large blocks of transformer loads or line fault currents picked up by the air break switch.

DETAILED DESCRIPTION OF THE INVENTION

Figure 1:
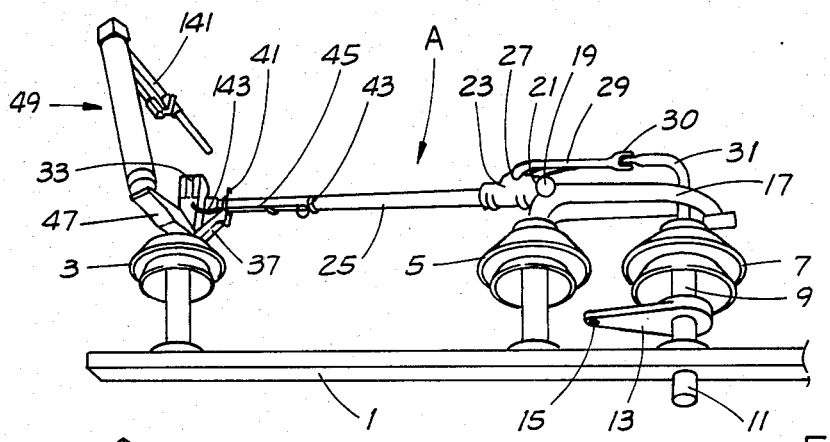
FIG. 1 is a perspective view of a vertical air break switch with load interrupter device constructed in accordance with the invention.

In the drawings the numeral A generally designates a high voltage air break switch having a rigid base 1 mounting a pair of spaced stationary insulators 3 and 5 and a rotatable insulator 7 which includes a downwardly extending shaft 9 adapted for rotation in a bearing 11 mounted in base 1. For the purpose of operating switch A, a crank arm 13 is fixed upon shaft 9 and projects radially therefrom. Crank arm 13 is provided with an operating eye 15 for connection to an operating rod (not shown). A support casting 17 is rigidly secured to fixed insulator 5 and extends rigidly therefrom to a position overlying rotatable insulator 7. Immediately above insulator 5 support casting 17 mounts a pivot member 19 to which is pivotally secured a switch blade mount 21 on which is rotatably mounted a fitting 23 to which tubular switch blade 25 is rigidly secured. Fitting 23 is provided with a pair of upstanding ears 27 which are pivotally secured to a bifurcated link 29 extending rearwardly therefrom and pivotally connected at its rear end at 30 to an arm 31 affixed to the top of rotatable insulator 7 for rotation therewith. Thus, rotation of insulator 7 will swing blade 25 upwardly and due to the rotatable mounting of blade 25 with respect to blade mounting member 21 will cause some rotation of blade 25 about its axis. Fixed insulator 3 rigidly mounts upwardly open U-shaped contact jaw member 33 and blade 25 is formed with a contact 35 of oblong cross section with its major axis horizontal and in engagement with the sides of the contact jaw 33 when the blade is in the horizontal closed position, blade contact member 35 being rotatable out of jaw-engaging contact, as previously described, during opening movements of the blade. A bracket 37 mounts an upwardly open yoke 39 having a pair of hook-like terminals 41 embracing the switch blade 25 and spaced somewhat therefrom and a bracket 43 on switch blade 25 mounts the ends of resilient copper arcing horns 45 spaced apart horizontally on opposite sides of blade 25 and normally engaging the inner surfaces of yoke 39, the purpose of arcing horns 45 being to remain in contact with yoke 39 after contact has been broken between blade contact 35 and contact jaws 33 and thus prevent arcing at the main contact jaws at this time, but being released from engagement with hooks 41 by a snap action as blade 25 moves upwardly away from the contact jaws.

Insulator 3 also mounts a bracket 47 to which is secured a vacuum interrupter device generally indicated at 49 and shown in greater detail in FIGS. 5-9.

Load interrupter device 49 has a base 51 securable by bolts passing through suitable holes 53 to bracket 47 on air break switch structure insulator 3, the upper portion 55 of base 51 being an upwardly open cylindrical flange in which is secured at its lower end a cylindrical housing 57 of dielectric material. A pair of cylindrical vacuum bottles 59 of ceramic material are centrally positioned in housing 57, each vacuum bottle 59 being formed with a stud 61 on its lower end, the stud 61 on the lower vacuum bottle 59 being threadably received in an upright stud sleeve 63 which is secured by a bolt 65 to a horizontal cross member 69 in base member 51.

Although only two bottles are shown, it will be understood that a greater number may be utilized, in which case the bottom stud 61 of each bottle except the lowest will be secured to the top plate 73 of an intermediate stacking pedestal. The upper end of lower bottle 59 is suitably secured to the bottom plate 71 of intermediate stacking pedestal casting consisting of bottom plate 71 and top plate 73, each having three equiangularly spaced radial arms 75, the outer extremities of which are connected by posts 78. For anchoring the intermediate stacking pedestal 73, 75, 78 to housing 57, a metal stud 74 projects radially outwardly from post 78 and through housing 57, to which it is externally secured by a nut 76, thus eliminating movement of the vacuum bottles and maintaining their adjustment during shipping and installation of the device. This eliminates excessive bellows stresses in the vacuum bottles and maladjustment of the contact synchronism.

Each of the vacuum bottles 59 has a pair of contact rods 77 and 79. Bottom contact rods 79 are stationary and, as previously mentioned, their lower ends project through the bottom of the bottles 59 and are threaded as at 61. The upper contact rods 77 are axially movable in the bottles 59 and are each provided at their upper ends with a threaded extension 80 which slidably projects upwardly through triangular operating plates 81, which are positioned above the respective vacuum bottles, i.e., between the upper and lower stacking pedestal plates 73 and 75. Each threaded contact rod extension 80 has a thumb nut 82 on its upper end with an enlarged head forming a shoulder above the upper surface of the respective operating plate 81, whereby when the operating plate is moved upwardly and engages the thumb nut shoulder, it raises the top contact rod 77 and when operating plate 81 returns to its normal position, a cushion spring 84 surrounding extension 80 and compressed between the bottom of the operating plate 81 and a washer 86 forming a shoulder on extension 80 pushes the upper contact rod 77 downwardly into contact with the lower contact rod 79, thereby ensuring conductive engagement between the contact rods. Successive operating plates 81 are connected to each other by vertical operating rods 83 of dielectric material such as Fiberglas, the end connections to the respective operating plates 81 of which are threadably adjustable as at 85. Between stacking pedestal bottom plates 75 and the adjacent operating plates 81, a group of symetrically and triangularly arranged compression springs 87 bias operating plates 81 upwardly which thereby bias top contact rods 77 upwardly and away from contact with bottom contact rods 79. The bottom 75 of the top stacking pedestal and the top 73 of the intermediate stacking pedestal and the bottom 75 of the intermediate stacking pedestal and base 51 are connected by capacitors 88 to provide a voltage grading effect across each vacuum bottle 59 corresponding to the voltage of the circuit to be interrupted. Resistors 90 in series with each group of capacitors 88 limit the amount of voltage by-passing the vacuum bottles 59 in the event of a breakdown of capacitors 88.

Figure 5:
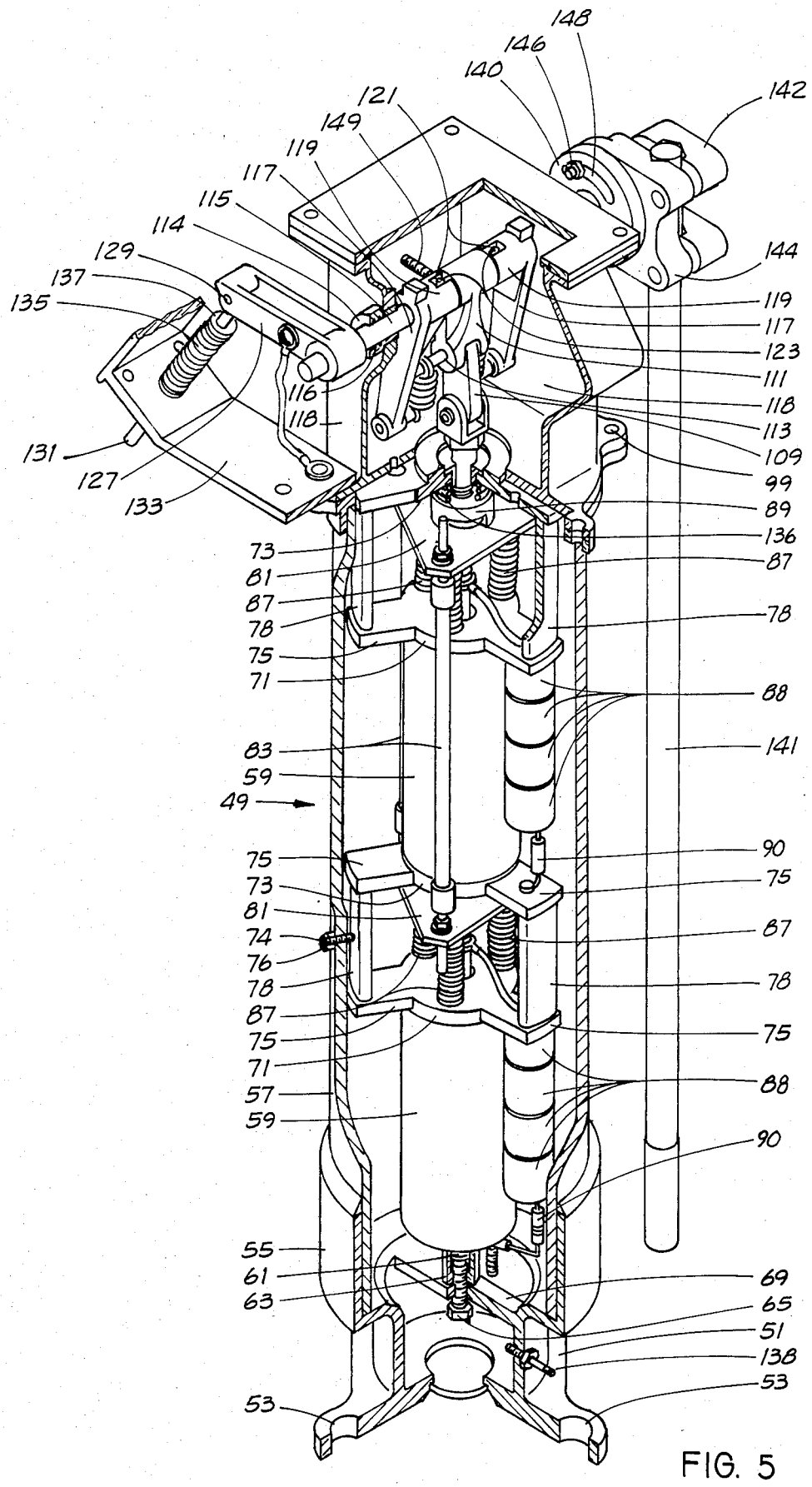
FIG. 5 is a cut-away isometric view of the load interrupter device shown in FIGS. 1-4.
Figure 7:
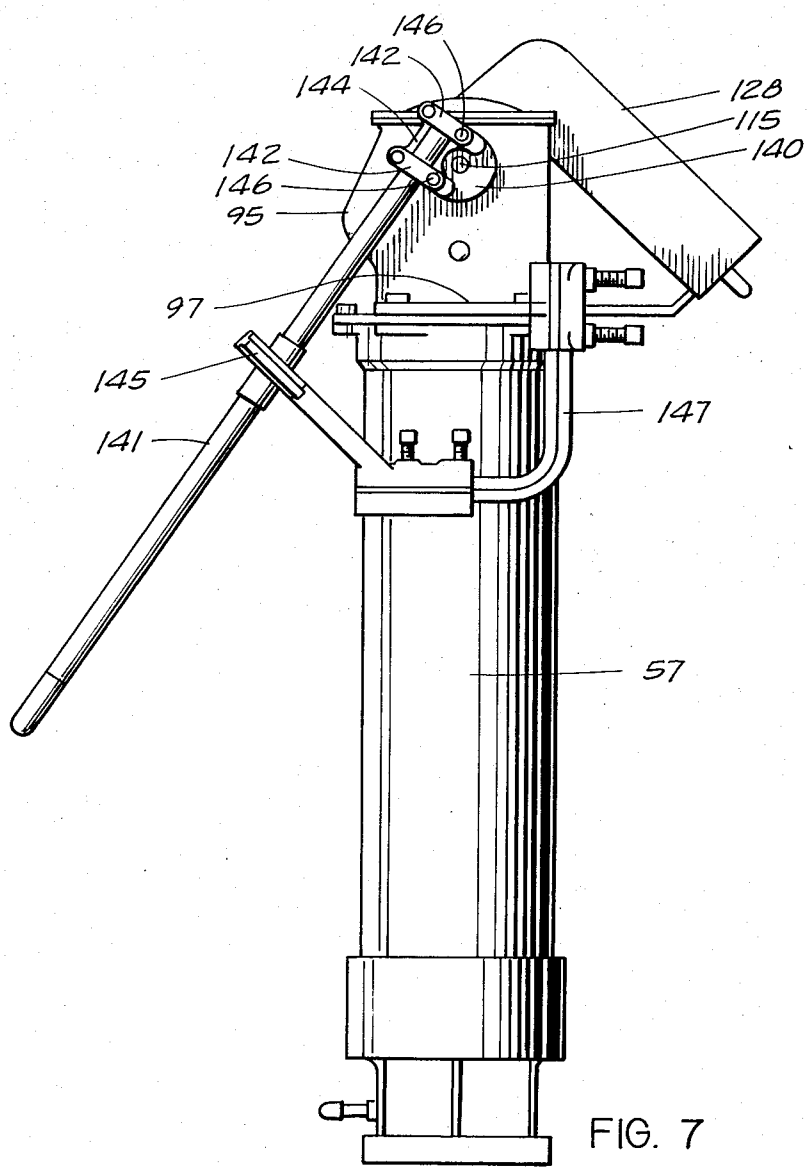
FIGS. 6 and 7 respectively are front and rear elevations of the interrupter device.
Figure 6:
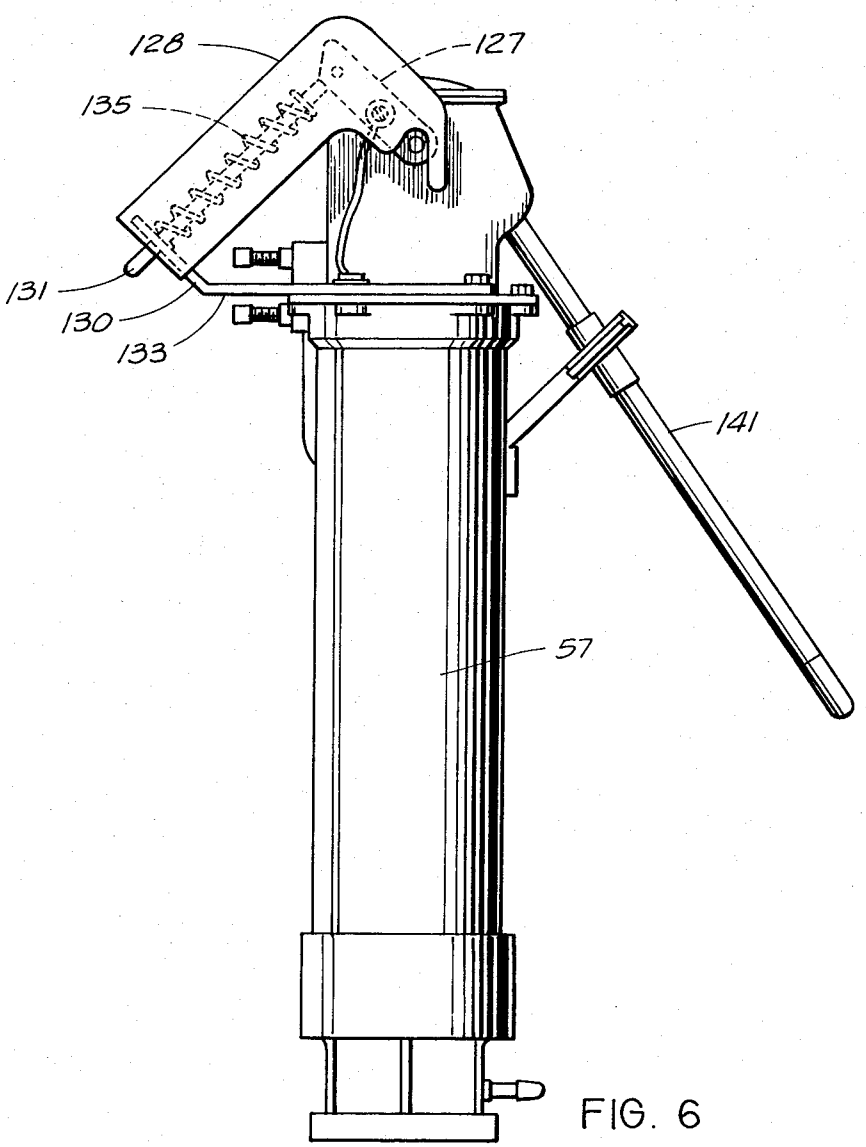

For operating the interrupter device, i.e., moving the top contact rods 77 into and out of engagement with bottom contact rods 79, the topmost operating plate 81 mounts an actuating yoke 89 surrounding the upwardly projecting extension 80 and its thumb nut 82 and threadably secured to the lower end of operating rod 91, which passes through a suitable bushing 93 in top plate 73 of the top stacking pedestal and upwardly thence into a box-like operating housing 95, the bottom of which is formed with a peripheral flange 97 secured by bolts 99 to an annular rim 101 having a cylindrical radial flange 103 receiving the upper margin of the dielectric cylindrical interrupter housing 57. At its upper end, actuator rod 91 is formed with an upwardly open clevis 105 which is pivotally secured at 107 to the lower link 109 of a normally vertically disposed toggle, the upper link 111 of which is pivotally connected at 113 to lower link 109. Upper link 111 is rotatably journaled on main operating shaft 115 which is journaled at 114 in the side walls 118 of the toggle mechanism housing 95. O-ring seals 116 are provided between the shaft 115 and the respective side walls 118. For operating the toggle 109, 111, a pair of normally downwardly extending arms 117 are journaled on main operating shaft 115, their elongated journal portions 119 being notched at 121 to receive radial pins 123 projecting from operating shaft 115 and forming with notches 121 lost-motion connections, whereby initial counterclockwise as shown in FIG. 5 (opening) movement of main operating shaft 115 produces no movement of arms 117, but continued movement of operating shaft 115 is communicated to arms 117 and causes them to move in the same counterclockwise direction. Arms 117 are connected at their lower ends to tension coil springs 125, the upper ends of which are connected to the pivot pin 113 connecting toggle links 109 and 111, such that movement of main operating shaft 115 and with its arms 117 from the position shown in FIG. 8 to that shown in FIG. 9, breaks the toggle, moving links 109 and 111 from their vertically aligned position of FIG. 8 to their angulated position of FIG. 9 and thereby freeing springs 87 to force operating plates 81 upwardly, and through engagement with contact rod thumb nuts 82, lift movable contact rods 77 upwardly to the open position shown in FIG. 9. Externally of the mechanism housing 95, operating shaft 115 mounts reset spring actuating arm 127, to the end of which is pivoted, at 129, a guide rod 131, the other end of which passes through the inclined end portion 130 of a bracket 133 mounted on the outside of housing 95, and a compression spring 135 surrounds guide rod 131 and is compressed between a fiber washer 137 on rod 131 and the inclined end portion 130 of bracket 133, to bias arm 127 and with it main operating shaft 115 and arms 117 to the position shown in FIG. 8, in which the toggle links 109 and 111 are substantially aligned with each other to cause upper contact rods 77 to engage lower contact rods 79 in vacuum bottles 59. To protect reset spring 135 and reset arm 127 from the weather, an L-shaped housing 128 of inverted channel cross section is mounted at its lower end on the inclined end portion 130 of bracket 133 with its long leg enclosing rod 131 and spring 135 and its short leg enclosing reset spring arm 127. To ensure that the vacuum bottle contact rods 77 and 79 are closed even though toggle links 109, 111 go slightly over center from their aligned position, overtravel spring 136 compressed between actuating pedestal 89 and top stacking pedestal top plate 73 overcomes the upward pressure of springs 87 to force operating plate 81 downwardly and to permit springs 84 to move the movable contact rods 77 downwardly into contact with fixed contact rods 79.

In order to keep the interior of the interrupter device dry and to maintain a constant basic impulse level within the interrupter device, it is filled with Nitrogen gas by means of Schrader valve 138 in base 51, and valve 138 is utilized to maintain pressure substantially constant in the order of 5 PSI, which offsets barometric pressure changes and keeps the O-ring seals 116 under constant pressure against operating shaft 115 to prevent moisture seepage into the interrupter, which could change the basic impulse level across the vacuum bottles and cause failure during interruption.

Figure 8:
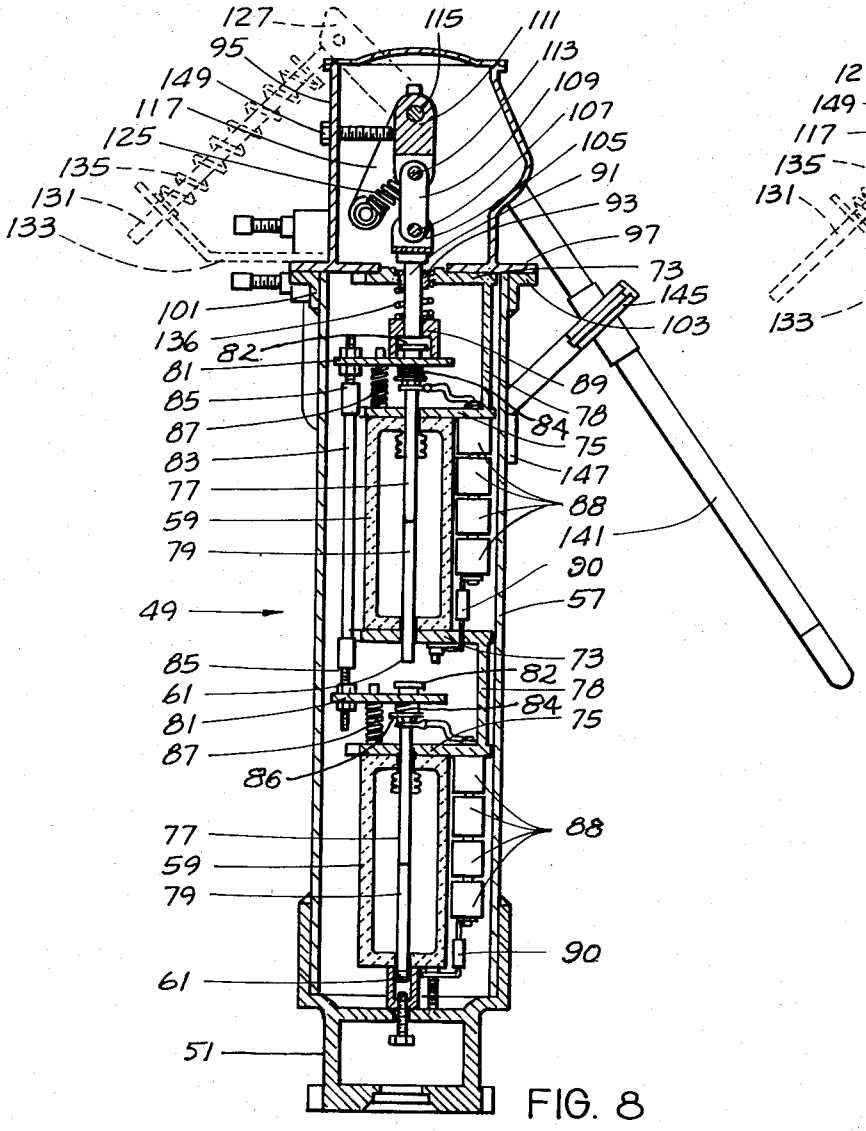

In the normal condition of the interrupter device 49, when air break switch blade 25 is in the closed position, as shown in FIG. 1, the interrupter device parts are in the position shown in FIG. 8, in which the circuit is closed through the contact rods 77 and 79. The interrupter operating shaft 115 mounts, via annularly flanged fitting 140, an elongated operating arm 141, which is clamped by clamp 142 to mounting block 144, which in turn is angularly adjustably secured to flanged fitting 140 by bolts 146 passing through arcuate slots 148 in flange fitting 140. Operating arm 141 is normally in the position shown in FIG. 8 until engaged by a hook 143 on air break switch blade 25. As will be seen in FIG. 2, as the opening cycle begins, arcing horns 45 are still engaged with arcing horn hooks 41 to prevent arcing until hook 143 has engaged interrupter operating arm 141, and after engagement of hook 143 with operating arm 141, arcing horns 45 are disengaged from arcing horn hooks 41 so that the current path is now directed through hook 143 and operating arm 141 into and through the engaged interrupter mechanism contact rods 77 and 79. After initial movement of operating arm 141 by engagement with air break switch blade hook 143, lost motion pins 123 engage notches 121 on actuating arm journal portions 119, causing the actuating arms 117 to move from the position of FIG. 8 to that of FIG. 9, thereby breaking the toggles 109 and 111 and permitting springs 87 acting through operating plates 81 and thumb nuts 82 to cause top contact rods 77 to move from the position shown in FIG. 8 to the open position shown in FIG. 9, thereby interrupting the full line load simultaneously with no arcing because of the impossibility of arcing in the vacuum in bottles 59.

Figure 4:
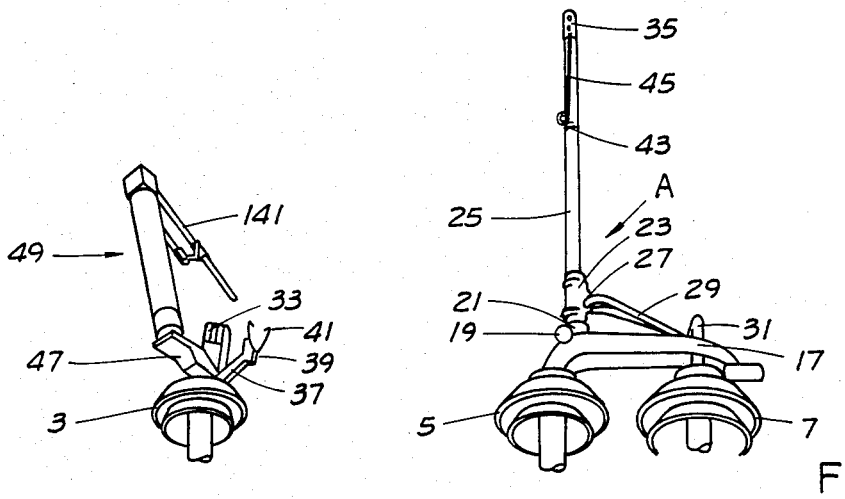
FIG. 4 corresponds to FIGS. 1-3, but shows the air break switch in its fully open position.
Figure 9:
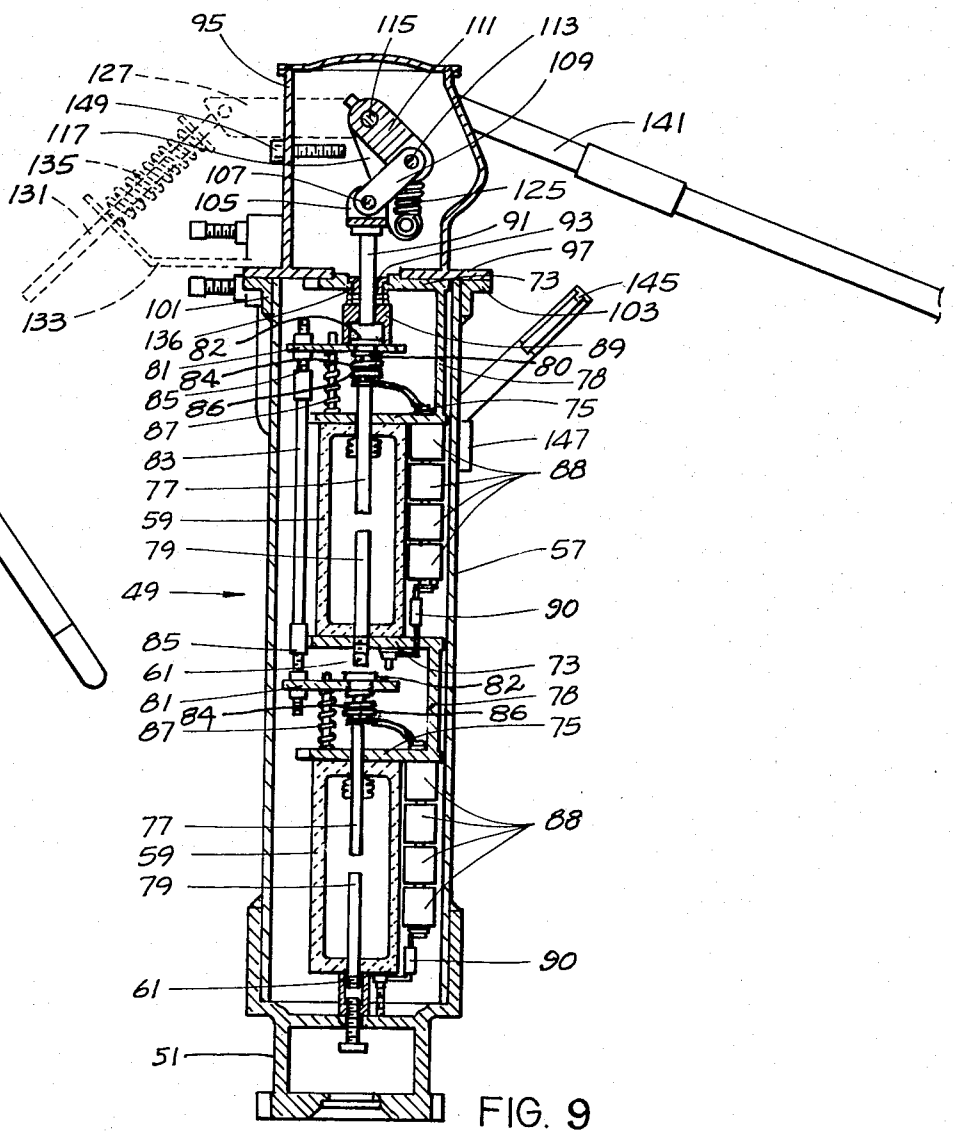
FIGS. 8 and 9 are respectively diametral vertical sectional views of the interrupter device illustrated in FIGS. 5-7 in closed and open positions respectively.

Thereafter, movement of switch blade 25 to the position shown in FIG. 4, in which switch blade hook 143 has become disengaged from interrupter operating arm 141, reset spring 135 urges reset arm 127 clockwise from the interrupter open position of FIG. 9 to the closed position of FIG. 8, causing toggle arms 109 and 111 to become realigned returning operating plates 81 to their normal position and permitting cushion springs 84 to close contacts 77 and 79 in each of the vacuum bottles 59, and returning operating arm 141 to its cocked position in engagement with V-shaped seat 145 mounted on a bracket 147 depending from mounting flange 97 of the toggle mechanism housing 95. To ensure that the distance of separation between switch blade 25 and stationary contact 33 is sufficient to prevent a restrike when the vacuum bottles open, an adjusting screw 149 adjustably positions toggle 111 to prevent premature opening of the vacuum bottles responsive to opening movements of operating arm 141.

Figure 2:
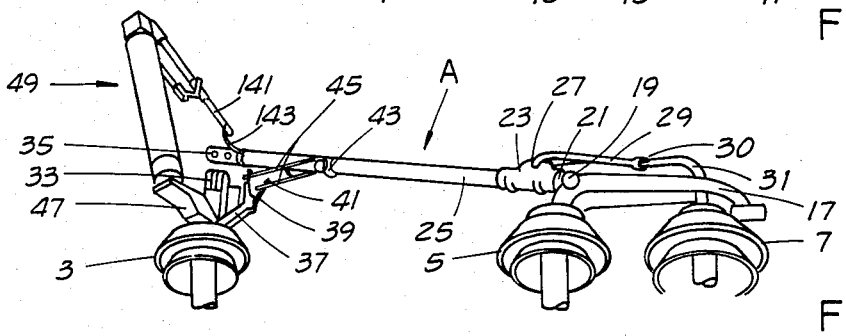
FIGS. 2 and 3 correspond to FIG. 1 and show intermediate partially open positions of the switch.
Figure 3:
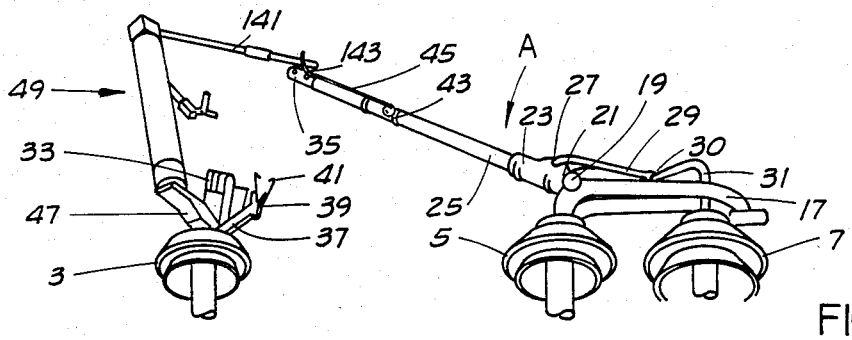

Operation of the device is as follows: With the air break switch in the position shown in FIG. 1, there is no contact between switch blade 25 and interrupter operating arm 141 and the interrupter is accordingly not in the circuit. Hence any excessive current or fault conditions cannot damage the interrupter device. Opening of air break switch blade 25 is initiated by rotation of rotatable insulator 7 which through crank 31 rotates bifurcated link 29, initially rotating switch blade 25 about its axis to disengage its contact 35 from fixed contact 33 and simultaneously swing switch blade 25 upwardly, i.e., clockwise as viewed in FIGS. 1–4, about pivot axis 19. While arcing horns 45 are still in engagement with hooks 41 on arcing horn yoke 39 so as to maintain a current path therethrough and prevent arcing between the switch blade contact 35 and fixed contact jaws 33, hook 143 on air break switch blade 25 engages interrupter operating arm 141, as seen in FIG. 2, to provide a current path from switch blade 25 through arm 141, operating shaft 115, toggle links 111 and 109, operating rod 91, operating rod pedestal 89, vacuum bottle contact rods 77 and 79, interrupter base 51 and interrupter bracket 47 on fixed contact insulator 3. With this current path established, arcing horns 45 become disengaged from arcing horn hooks 41, leaving the current path just described through the interrupter as the sole current path, and as switch blade 25 moves toward the position shown in FIG. 3 it produces counterclockwise rotation of main operating shaft 115 and corresponding rotation of lost motion pins 123 in lost motion notches 121 on the journal portions 119 of arms 117, thereupon causing arms 117 to rotate counterclockwise to pull toggle pivot pin 113 to the right, disaligning toggle links 109 and 111 and permitting compression springs 87 to move operating plates 81 upwardly and thereby move top contact rods 77 upwardly and out of contact with bottom contact rods 79 to break the circuit in the vacuum in bottles 59 and thus avoid arcing. Further opening movement of the switch blade 25 from the position shown in FIG. 3 to FIG. 4 disengages hook 143 from interrupter operating rod 141 thus taking the interrupter device out of the circuit and permits reset spring 135 to act through reset arm 127 to rotate operating shaft 115 clockwise and return operating rod 141 to its cocked position seated in V-shaped seat 145 supported from the interrupter housing, there being no arcing when hook 143 disengages operating rod 141 by virtue of the contact having been broken in the interrupter vacuum bottles 59. When this occurs arms 117 move clockwise from the position in FIG. 9 to the position in FIG. 8, pulling toggle pivot pin 113 to the left and thereby returning toggle links 109, 111 to their normal substantially aligned position, in which link 111 is positioned by its abutting engagement with adjustment screw 149, causing downward movement of operating rod 91 and of operating plates 81 and connecting rods 83, aided by overtravel spring 136. The interrupter remains out of the circuit when the switch blade is closed and until, during the opening cycle, the switch blade reaches the position shown in FIG. 2, so that the interrupter cannot be damaged by large blocks of transformer loads or fault currents picked up by the air break switch upon closing.

The details of the switch gear and interrupter device disclosed herein may be varied substantially without departing from the spirit of the invention and the exclusive use of such modifications as come within the scope of the appended claims is contemplated.

I claim:

1. A load interrupter device for use with air break switch gear comprising an elongated housing of dielectric material, at least one vacuum bottle positioned within said housing and having a fixed and a movable contact axially aligned with respect to said fixed contact in the bottle, said axially movable contact being movable between a closed position engageable with said fixed contact and an open position spaced from said fixed contact, interrupter operating mechanisms including a mechanism housing secured to one end of said elongated housing, an operating shaft journaled in the walls of the mechanism housing and extending transversely of said elongated housing with its axis substantially co-planar with the axes of said fixed and movable contacts, an operating arm connected to the operating shaft, a first toggle link rotatably journaled on said operating shaft and extending outwardly therefrom to an opposite end, a second toggle link pivoted to the opposite end of said first toggle link at a location spaced from said operating shaft, means pivotally connecting the other end of said second toggle link to means for controlling the position of the movable contact relative to the fixed contact including first means to maintain the fixed and movable contacts in engagement when the first and second toggle members are in substantial alignment, second means operatively engageable with the pivotally connected other ends of the toggle members including means to cause the first and second toggle members to move out of alignment and to cause the movable contact to move away from the fixed contact, said last named means including a lost motion connection, and means on the mechanism housing engageable with the toggle links adjacent to the pivotally connected ends thereof to control and maintain the positions of the toggle links in their substantially aligned condition.

2. The load interrupter device according to claim 1 wherein an actuating arm is journaled on said operating shaft and extends outwardly therefrom, spring means connecting the actuating arm to said pivotal connection between said first and second toggle links at a location spaced from the operating shaft whereby predetermined rotation of said operating shaft causes force to be applied from the actuating arm through said spring to pull said toggle links out of their substantially aligned positions allowing the movable contact to move out of engagement with said fixed contact.

3. The load interrupter device according to claim 2 wherein said lost motion connection is located between said operating shaft and said actuating arm permitting limited initial rotation of said operating shaft before any of movement of the actuating arm takes place.

4. The load interrupter device according to claim 3 wherein said lost motion connection includes circumferentially spaced abutment means located respectively on the actuating arm and on said operating shaft.

5. The load interrupter device according to claim 1 wherein the means on the mechanism housing engageable with the toggle links adjacent to the pivotally connected ends thereof includes an adjusting screw mounted on said operating mechanism housing.

6. The load interrupter device according to claim 2 including resilient means operatively connected between the operating shaft and the mechanism housing and operable for restoring said operating shaft and the actuating arm thereon to reset positions represented by the toggle links being in their substantially aligned positions and the movable contact engaging the stationary contact.

7. The load interrupter device according to claim 1 including a fitting at the opposite end of said dielectric housing from said mechanism housing for mounting said device on an air break, and means conductively connecting said vacuum bottle to said fitting.

8. The load interrupter device according to claim 1 wherein said means for controlling the position of the movable contact relative to the stationary contact comprises an operating rod axially aligned with said fixed and movable contacts, a plate-like member rigidly connected to said operating rod for movement therewith, said movable contact having an axial extension passing through said plate-like member and formed with a shoulder engageable with said plate-like membr upon movement of the latter caused by the first and second toggle links moving to their out of alignment positions whereby to move said movable contact out of engagement with said fixed contact upon predetermined movement of said plate-like member, and resilient means biasing said movable contact into conductive engagement with said fixed contact when said toggle links are aligned.

9. The load interrupter device according to claim 8, including a mounting fitting attached to one end of the elongated housing, a plurality of said vacuum bottles aligned with each other within said elongated housing, a pedestal structure between one of said vacuum bottles and the one end of said elongated housing and between said one vacuum bottle and another vacuum bottle adjacent thereto for centrally positioning said vacuum bottles in axial alignment with each other within said elongated housing, a similar pedestal structure between each pair of adjacent vacuum bottles, each said pedestal structure comprising a pair of plate members spaced apart axially of the elongated housing from each other and having a post member extending parallel to the elongated housing joining them, said plate-like member associated with said one vacuum bottle and the similar plate-like members positioned between each pair of adjacent vacuum bottles being positioned between the axially spaced pedestal structures, the fixed contact of the said one vacuum bottle being secured to the adjacent plate member of the adjacent intermediate pedestal structure and the fixed contact of the vacuum bottle furthest from the said one vacuum bottle in the elongated housing being secured to the mounting fitting, the moveable contacts of the second and succeeding vacuum bottles being connected to the respective plate-like members between the respective adjacent vacuum bottles in the same manner as the said one vacuum bottle movable contact is connected to its respective plate-like member, and dielectric rod means connecting said first and succeeding plate-like members to produce identical simultaneous movement thereof axially of said elongated housing and thereby to also cause simultaneous opening and closing of all of the fixed and movable contacts in the plurality of vacuum bottles.

10. The load interrupter device according to claim 9 in which a stabilizing stud extends radially from the intermediate pedestal structure through the dielectric housing wall and threadably receives a nut for fixedly positioning the intermediate pedestal and the vacuum bottles secured thereto within said housing.

11. The load interrupter device according to claim 9 including an electrically conductive connection between each said movable contact and the adjacent pedestal structure, and capacitors and resistors in series connect the first and intermediate stacking pedestals and the intermediate stacking pedestal and the mounting fitting to provide a voltage grading effect across each vacuum bottle corresponding to the voltage of the circuit to be interrupted and to limit the voltage bypassing the vacuum bottle in the event said capacitors break down.

12. The load interrupter device according to claim 1 including means for introducing and retaining an inert gas at a predetermined superatmospheric pressure in the interior of the elongated housing and in the mechanism housing.

13. The load interrupter device according to claim 12 wherein said gas retention means includes O-ring seals between said operating shaft and the walls of said mechanism housing.

14. A load interrupter device for use with air break switch gear comprising an elongated housing of dielectric material, a plurality of vacuum bottles aligned with each other within said housing and each having extending therein from one end a fixed contact and extending therein from the opposite end a movable contact axially aligned with respect to said fixed contact and axially movable between a closed position in engagement with said fixed contact and an open position spaced from said fixed contact, operating mechanism including a mechanism housing therefor secured to one end of said elongated housing, a fitting secured to the end of said elongated housing remote from said operating mechanism housing for mounting the device on an air break switch gear, a stacking pedestal structure between a first vacuum bottle and the end of said elongated housing adjacent said operating mechanism housing and a similar pedestal structure between adjacent pairs of vacuum bottles within said housing to support the vacuum bottles in axial alignment with each other, the adjacent ends of pairs of said vacuum bottles being secured to the adjacent pedestal structure and the end of the vacuum bottle adjacent said mounting fitting being secured to said mounting fitting, each of said intermediate stacking pedestal structures being engageable by a conductive stabilizing stud that extends radially outwardly through the dielectric elongated housing wall and threadedly receives a nut, said stabilizing studs being adjustable in the elongated housing for positioning said intermediate pedestal structures and the vacuum bottles secured thereto within said housing and to provide a point for electrical connection to permit selective testing of the respective vacuum bottles.

15. Electrical circuit interrupter means comprising an air break switch having a fixed contact element, a switch blade pivoted at one end for movement from a closed position conductively engaging said fixed contact element to an open position disengaged from said fixed contact, an interrupter device mounted on and conductively connected at one end to said fixed contact element, said interrupter device comprising an elongated housing of dielectric material, at least one vacuum bottle positioned within said housing and having a fixed first contact and a movable second contact having adjacent ends positioned in the vacuum bottle, said movable second contact being axially aligned with respect to said fixed first contact and axially movable between a closed position engageable with said fixed first contact and an open position spaced from said fixed first contact, operating mechanism including a mechanism housing secured to the end of said elongated housing remote from the mounting on said fixed contact, an operating shaft journaled in the walls of and extending transversely of said mechanism housing with its axis substantially co-planar with the axes of said first and second contacts, a first toggle link rotatably journaled on said operating shaft and extending outwardly therefrom to an opposite end, a second toggle link pivotally connected to the opposite end of said first toggle link at a location spaced from the operating shaft, means pivotally connecting the other end of said second toggle link to said movable second contact, means on said mechanism housing engageable with the first and second toggle links in one position thereof to maintain said toggle links in a substantially aligned relation with each other and with the aligned first and second contacts to maintain said movable second contact in engagement with said fixed first contact, and other means including means operatively connected to the operating shaft for moving against the first and second toggle links when they are in the aligned condition to move the said first and second toggle links to an out of aligned condition thereby causing said movable second contact to move out of engagement with the fixed first contact, said other means including an operating arm affixed to the operating shaft in position for conductive engagement with the air break switch blade, said other means including means to maintain electrical contact between the operating arm and the fixed contact after said air break switch blade has moved away from said fixed contact element toward the open position thereof to provide an alternate current path through said interrupter device, said operating arm simultaneously rotating said operating shaft in a direction to move the first and second toggle links out of alignment, said means to maintain electrical contact between the switch blade and the fixed contact separating to break said electrical contact prior to full movement of said switch blade toward the fully open position, and resilient means operatively connected to said operating shaft for restoring said operating shaft and the means thereon to their reset positions independently of the position of the switch blade, whereby said toggle links are restored to their normal substantially aligned positions to reclose said first and second contacts.

16. The load interrupter device according to claim 15 including means to adjust the angular orientation of the operating arm relative to the operating shaft.

17. The load interrupter device according to claim 15 including means to adjust the axial position of the operating arm relative to the operating shaft to change the location of the operating arm during movement thereof where the electrical contact between the switch blade and the fixed contact breaks.

* * * * *